United States Patent [19]

Smilow et al.

[11] 4,453,655

[45] Jun. 12, 1984

[54] DISPLAY HANGER FOR BELTS

[75] Inventors: George Smilow, Yonkers; Samuel L. Kayen, Elmont, both of N.Y.

[73] Assignee: B & G Plastics, Inc., New York, N.Y.

[21] Appl. No.: 412,865

[22] Filed: Aug. 30, 1982

[51] Int. Cl.[3] ..... A47J 51/097

[52] U.S. Cl. ..... 223/87; D6/251; 211/13; 211/60 R; 211/113; 248/339

[58] Field of Search ..... 223/85, 87; 211/13, 211/60 R, 113; 248/339, 340; 24/255 BS; D6/251

[56] References Cited

U.S. PATENT DOCUMENTS 3,244,334 4/1966 Marlar ..... 223/87 X 3,710,996 11/1973 Smilow et al. ..... 223/87

4,063,669 12/1977 Smilow et al. ..... 223/87

4,141,445 2/1979 Korich ..... 211/13 X

*Primary Examiner*—Robert Mackey

*Attorney, Agent, or Firm*—Charles E. Temko

[57] ABSTRACT

A multi-purpose display hanger for belts having means for selectively supporting such belts by the buckle element thereof upon a horizontally disposed rod or similar support. Means is provided for engaging that type of buckle having a centrally disposed pivotally mounted prong, or that type of buckle having a laterally extending projection on an inner surface thereof for engaging any of a series of holes in an oppositely disposed end of the belt.

2 Claims, 7 Drawing Figures

DISPLAY HANGER FOR BELTS

BACKGROUND OF THE INVENTION

This invention relates generally to the field of apparel display devices, and more particularly to an improved belt hanger adapted to support an apparel belt from the buckle end thereof in depending condition in such manner that plurality of such devices may be selectively engaged with a horizontally supported rod whereby a plurality of belts may be displayed in a given area, and selectively removed by a purchaser.

Devices of this general type are known in the art, and usually include provision not only for the engagement of the belt buckle, but for the displaying of appropriate information, such as price, size, the name of the manufacturer and the like.

While the most common type of belt buckle is still the traditional one, featuring a pivotally mounted central prong selectively engaged with any of a plurality of holes in an opposite end of the belt strap, in recent years there has been a substantial increase in the manufacture and sale of that type of buckle in which the hole engaging member is in the form of a relatively short fixed member extending laterally from a rear surface of a rigid main body portion of the belt buckle.

In our prior U.S. Pat. No. 4,063,669, granted Dec. 20, 1977, we have disclosed a construction capable of accommodating the traditional form of buckle, as well as one type of the newer construction in which the laterally extending member is provided with an enlargement on the tip thereof. It is not possible to use that construction with one of the newer forms in which no such enlargement is present, for the reason that a positive engagement is not possible.

SUMMARY OF THE INVENTION

Briefly stated, the invention contemplates the provision of an improved belt display hanger of the class described, which is particularly adapted to accomodate a maximum number of types of belt buckles for attractive display upon a horizontal rod, in which provision is made for the selective engagement of the pivotally mounted central prong type buckle, and that type of buckle having a laterally extending shank with an enlargement thereon, as well as that type of buckle having a laterally extending shank of outwardly tapering configuration. To this end, the inventive structure includes the usual main body portion, and a composite pendant member having a laterally extending L-shaped extension for engaging the traditional buckle, and a planar perforated member for engaging those types with a laterally extending shank. In the case of the tapered shank, the L-shaped extension assists in the maintenance of engagement with the hanger.

BRIEF DESCRIPTION OF THE DRAWINGS

In the drawings, to which reference will be made in the Specification, similar reference characters have been employed to designate corresponding parts throughout the several views.

DETAILED DESCRIPTION OF THE DISCLOSED EMBODIMENT

Figure 4:
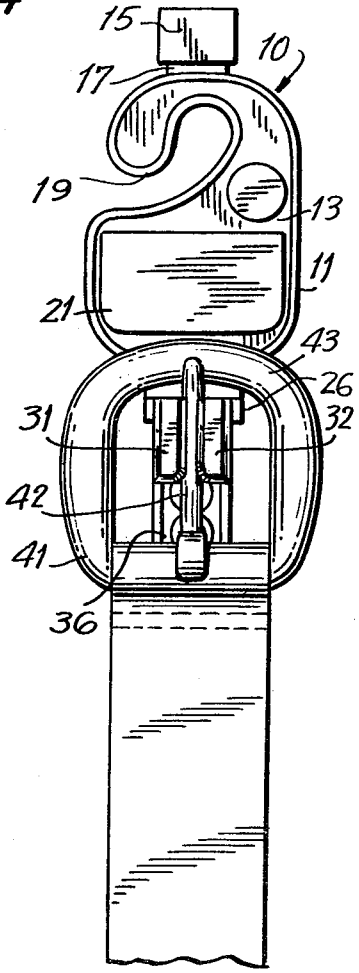
FIG. 4 is a front elevational view thereof showing the device in engaged condition with a conventional prong-type belt buckle, and a horizontally disposed supporting rod.
Figure 3:
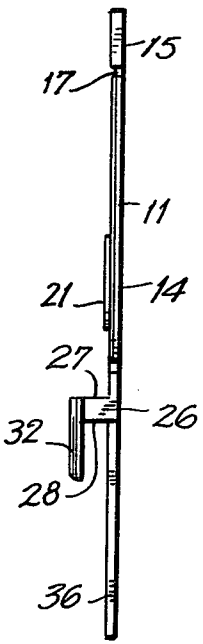
FIG. 3 is a side elevational view thereof.
Figure 2:
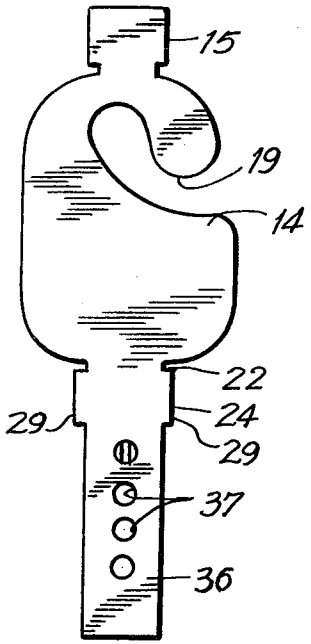
FIG. 2 is a rear elevational view thereof.
Figure 1:
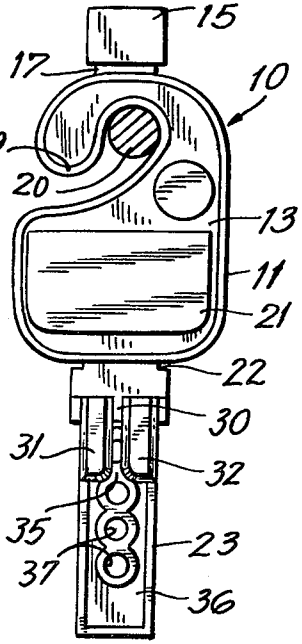
FIG. 1 is a front elevational view of an embodiment of the invention.

In accordance with the invention, the device, generally indicated by reference character 10, is preferably in the form of a single molding from synthetic resinous materials. It is bounded by a continuous peripheral edge 11, as well as first and second planar surfaces 13 and 14. An upper identification tab 15 is interconnected with a main body portion by a short neck 17. The portion is provided with a curvilinear slot 19, an upper edge of which is selectively engageable with a horizontally disposed supporting rod 20, as is known in the art. A raised rectangular surface 21 provides for the imprinting of additional indicia. A lower neck 22 interconnects with an elongated belt engaging element 23, an upper end 24 of which is provided with a laterally extending recess-forming member. The member is of generally inverted L-shaped configuration, including a rectangularly shaped base portion 26 bounded by an upper surface 27, a lower surface 28, and end surfaces 29. A through channel 30 extends between the upper and lower surfaces 27 and 28. A pair of downwardly extending tab portions 31 and 32 have upper ends 33 integrally formed with the base portion 26 and free lower ends. The portions 31 and 32 are spaced apart to form a groove 35 overlying the channel 30. A strap portion 36 extends downwardly from the base portion 26, and is provided with a plurality of holes 37 extending over a span of approximately 1 inch.

Referring to FIG. 4, there is shown a conventional type buckle 41 having a pivotally mounted prong 42 engaged with the base portion 26, the prong being disposed within the channel 30, and detented by the groove 35. In this position, an end member 43 of the buckle is supported on the upper surface 27.

Figure 6:
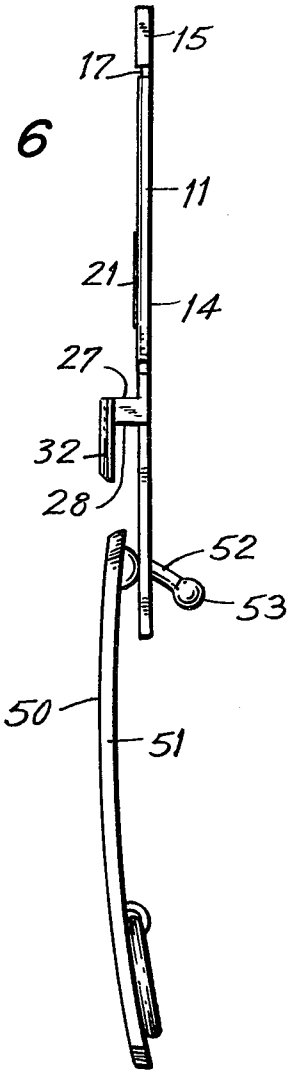
FIG. 6 is a side elevational view thereof, similar to that seen in FIG. 5, in engagement with a second type of belt buckle.
Figure 5:
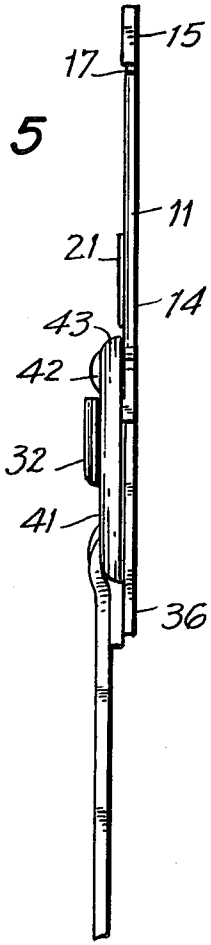
FIG. 5 is a side elevational view thereof as seen from the right-hand portion of FIG. 4.

FIG. 6 illustrates the engagement of a second type of belt buckle 50 having a relatively flat main body 51 and a rearwardly extending projection 52 with an enlargement 53 thereon. The projection 52 is engaged with any of the holes 37 to be retained by the enlargement 53.

Figure 7:
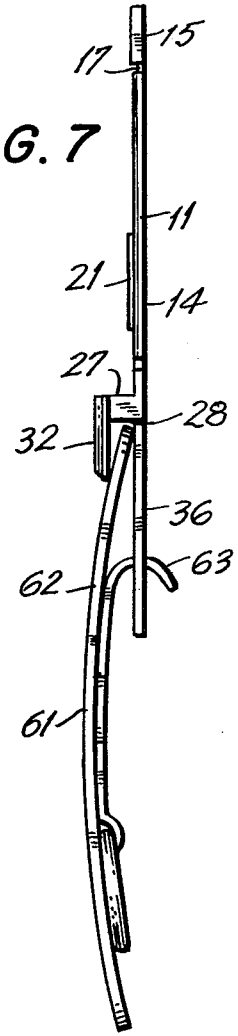
FIG. 7 is a side elevational view thereof, similar to that seen in FIG. 5, but showing a third type of belt buckle in engagement therewith.

FIG. 7 illustrates the engagement of the device with a third type of buckle 61 having a relatively flat main body 62, and a laterally extending projection 63. The projection 63 is both curved and tapered, and relies upon engagement with a hole in the belt strap upon normal tension involved in wearing the belt. Thus, a positive engagement with one of the holes 37 is not possible. This is accommodated by the fact that the downwardly extending portions 31 and 32 form a channel with the strap portion 36 in which the free edge of the body 62 may be positioned, following which the projection may be engaged with one of the holes 37, depending upon the relative location of the projection with respect to the main body.

It may thus be seen that we have invented novel and highly useful improvements in belt display hangers which provide accomodation for currently popular belt styles in that a plurality of belt buckle types may be readily accommodated for engagement without adjustment of the hanger. As is the case with prior art devices of this type, the present device may be conveniently injection molded from synthetic resinous materials at a cost sufficiently low to permit complete expandability after a single use.

We wish it to be understood that we do not consider the invention limited to the precise details of structure shown and set forth in this Specification, for obvious modifications will occur to those skilled in the art to which the invention pertains.

We claim:

1. a display hanger for belts having varying types of belt buckles at one end thereof comprising: a unitary piece of synthetic resinous material including a main body having hook means for engaging a supporting rod, and a depending buckle-engaging element connected to said main body; said buckle-engaging element including an elongated portion adjacent said main body portion having at least one opening therein extending through the plane thereof and a laterally extending recess forming member having an upper surface and supported by said elongated portion and including a base defining an axially oriented expandable slot therein, said slot being adapted to engage the pivotally mounted centrally disposed prong of a belt buckle while said buckle is supported from said upper surface of said recess forming member; and a pair of downwardly extending tabs secured at the upper ends thereof to said recess forming member on either side of said slot, and at least partially over-lying at least one opening in said elongated portion to define a channel into which a buckle having a laterally extending projection thereon may be inserted, said projection engaging said at least one opening.

2. A hanger in accordance with claim 1, further characterized in the provision of a plurality of openings in said elongated portion to accommodate for differing relative locations of said larterally extending projection relative to said belt buckle.

* * * * *